United States Patent [19]

Bowman

[11] Patent Number: 4,966,489

[45] **Date of Patent: * Oct. 30, 1990**

[54] MANHOLE COVER SUPPORT HAVING INTERBRACED TOP MEMBERS

[76] Inventor: Harold M. Bowman, 18867 N. Valley Dr., Fairview Park, Ohio 44126

[ * ] Notice: The portion of the term of this patent subsequent to Sep. 19, 2006 has been disclaimed.

[21] Appl. No.: 362,216

[22] Filed: Jun. 6, 1989

Related U.S. Application Data

[63] Continuation-in-part of Ser. No. 201,573, Jun. 1, 1988, Pat. No. 4,867,600, and Ser. No. 323,622, Mar. 14, 1989, abandoned, and Ser. No. 207,185, Jun. 15, 1988, Pat. No. 4,872,780, and Ser. No. 207,266, Jun. 15, 1988, Pat. No. 4,867,601, and Ser. No. 207,326, Jun. 15, 1988, abandoned, and Ser. No. 207,325, Jun. 15, 1988, abandoned, and Ser. No. 76,668, Jul. 23, 1987, Pat. No. 4,834,574.

[51] Int. Cl.[5] ..... E02D 29/14

[52] U.S. Cl. ..... 404/26; 52/20

[58] Field of Search ..... 404/25, 26; 52/19-21; 49/41, 466, 505; 160/374.1

[56] References Cited

U.S. PATENT DOCUMENTS

| | | | |
|---|---|---|---|
| 1,908,909 | 5/1933 | Manz | 52/19 |
| 3,773,428 | 11/1973 | Bowman | 404/26 |
| 4,097,228 | 6/1978 | Rosling | 49/466 X |
| 4,302,126 | 11/1981 | Fier | 404/26 |
| 4,582,450 | 4/1986 | Neil | 404/26 |
| 4,834,574 | 5/1989 | Bowman | 404/26 |
| 4,867,601 | 9/1989 | Bowman | 404/26 |

OTHER PUBLICATIONS

One page from Spec. No. 715-13, N.Y. State Dept. of Transportation, Albany, N.Y., entitles "715-13 Prefabricated Adjustment Rings and Frames for Drainage Units and Manholes"—published prior to 1983.

*Primary Examiner*—Jerome W. Massie, IV
*Assistant Examiner*—Matthew Smith
*Attorney, Agent, or Firm*—Watts, Hoffmann, Fisher & Heinke Co.

[57] ABSTRACT

An improved manhole cover support having a metal body comprising base, seat, and keeper portions, the keeper portion rising above the seat portion and having at least a pair of opposing ends that define a gap between them, a bridging piece for spanning each gap, the bridging piece having at least one free end, a receiver for slidably retaining each free end of each bridging piece, the receiver attached to and protruding outwardly from the keeper portion near the top thereof, the bridging piece including 2 turnbuckle for exerting parting pressure against the receivers that retain it.

27 Claims, 4 Drawing Sheets

MANHOLE COVER SUPPORT HAVING INTERBRACED TOP MEMBERS

REFERENCE TO OTHER APPLICATIONS

This patent application is a continuation-in-part of applicant's: Ser. No. 07/201,573, filed June 1, 1988, entitled *Polygonal Manhole Cover Support,* now U.S. Pat. No. 4,867,600 of Sept. 19, 1989 ; Ser. No. 07/323,622, filed on March 14, 1989, entitled *Support for a Manhole Cover of Standardized Diameter* abandoned; an application filed on even date herewith, entitled *Multicomponent Wales and Bases for Manhole Cover Supports,* now Ser. No. 07/362,257, Ser. No. 07/207,185 filed on June 15, 1988, entitled *Manhole Cover Support with Box Flanging,* now Pat. No. 4,872,780 of Oct. 10, 1989; Ser. No. 07/207,266 filed on June 15, 1988, entitled *Sturdy Adjustable Manhole Cover Support,* now Pat. No. 4,867,601 of Sept. 19, 1989; Ser. No. 07/207,326 filed on June 15, 1988, entitled *Manhole Cover Support Having Enhanced Grip* abandoned; Ser. No. 07/207,325 filed on June 15, 1988, entitled *Manhole Cover Support Resistant to Water Infiltration* abandoned; and Ser. No. 07/076,668, filed on July 23, 1987, entitled *Utility Cover Extension,* now U.S. Pat. No. 4,834,574 of May 30, 1980. The teachings of these applications are incorporated herein by reference.

BACKGROUND OF THE INVENTION

This invention relates to manhole cover supports for emplacing over and raising the effective grade of an existing manhole cover receiving structure such as the usual cast iron manhole cover frame, and more particularly to manhole cover supports having gaps in their lateral keepers for the cover, especially those cover supports that are polygonal in plan.

For simplicity the term "existing manhole cover receiving structure"is used here to refer to the existing, i.e., fixed-in-place frame or other seating receptacle for a removable cover or grating that covers an access hole (i.e., hand hole, tool hole, manhole, catch basin or the like). The term "manhole cover" is used to refer to the removable cover or grating over the access hole. The resulting assembly of a receiving structure and a manhole cover ordinarily is intended to bear vehicular traffic. The term "manhole cover support" or simply "cover support" here means a structure that fits over the existing manhole cover receiving structure, raises its grade, and thereby accommodates a cover or grating at the new elevated grade. The access hole covered is a utility enclosure serving, e.g., an electric, gas, water, sewer or storm drainage system.

Ordinarily the instant cover support finds its use when a roadway such as a street or highway is resurfaced with a layer of paving material. Typically asphalt concrete is overlaid or repaved to establish a higher grade. It then is advantageous to mount the inventive cover support atop the existing manhole receiving structure. Prior art on manhole cover supports and manhole cover frames can be found in U.S. Pat. Nos. 4,281,944, 4,236,358, 3,968,600, 3,773,428, 4,097,171, 4,302,126, 3,891,337 and 1,987,502. The first four of these are for inventions of the applicant.

Axle loads up to 40,000 pounds must be resisted by many of these cover supports as well as serious impact loads from vehicles and snow plows, a variety of temperature effects, steam leaks, spillage, etc., without permitting a hazardous dislocation of the cover support or its cover. Often it is desirable also to cushion the cover a bit for resisting wear or reducing noise, or to seal the cover and its cover support against a substantial and possibly overloading infiltration of surface water, e.g., storm drainage that otherwise would enter a sanitary sewer system at various manhole locations. Adjustability of the cover support in peripheral dimension and height also is desirable for accommodating the wide range of specifications to be met.

Installing, adjusting, loading and unloading and otherwise handling manhole cover supports and removing the covers therefrom usually is done with powerful and indelicate tools such as picks, pinch bars, crowbars, tongs, heavy hooks and the like. Deformation of the cover support can occur, particularly about its upper edge which is nearest the road surface. Also, the upper edge usually is the handiest area for applying lifting and other tools. Deformations along the top never are good, and they can render the opening of the support unfit for service. Hence, overall ruggedness and stiffness against deformation, especially at or near the top rim, and resistance to displacement are major concerns about manhole cover supports.

On the other hand, a relatively light construction of the cover support, in comparison to the usual ponderous cast iron frame that usually initially supports the manhole cover when the first paving is laid, can be very desirable, provided, however, that an inordinate amount of the ruggedness, stiffness, and resistance to displacement or dislodgement is not sacrificed. Usually a main place for weight reduction is in the lateral keeper for the cover. Another place is in the base of the cover support. Clearly, the economics of manufacture, handling and installation all are generally in favor of lower weight. A relatively thin wall keeper would normally be of steel; it is rarely more than about 0.1 inch (12 ga.) thick and usually is less.

The instant cover support is an improvement in a cover support having gaps in the lateral keepers for the cover, particularly those supports of the first, third and fourth parent applications referred to above. The first of these was for a polygonal cover support having adjustable joints at the corners for manipulating the peripheral dimension and the base pressure against reaction surfaces. The third and fourth of these call for hollow wale portions substantially coextensive with the upper part of the cover keeper portion of a metal manhole cover support for stiffness of the relatively light wale and for an improved, more easily made wale of that type.

The instant invention renders the upper parts of the manhole cover support mutually bracing. This imparts greater ruggedness, particularly where those parts are made of fairly thin metal such as 12 gauge (0.1 inch thick) mild steel.

Additionally, this improved cover support can be adapted readily, like its cover supports, of its parent applications, to be sealed off against water infiltration and to cushion the cover. Its base can be made adjustable as to outer perimeter if desired.

BROAD STATEMENT OF THE INVENTION

The instant manhole cover support has a metal body comprising a base portion, a seat portion thereabove for seating the manhole cover, the seat portion directed inwardly, a cover keeper portion that rises from the outer periphery of the seat portion, the cover keeper portion having at least a pair of opposing ends that define a gap between them, a bridging piece for spanning each said gap, the bridging piece having at least one free end, a receiver for slidably retaining each free end of each bridging piece, the receiver being attached to and protruding outwardly from the keeper portion near the top thereof, the bridging piece including means for exerting pressure against the receivers that retain it.

BEST MODE FOR CARRYING OUT THE INVENTION

Figure 1:
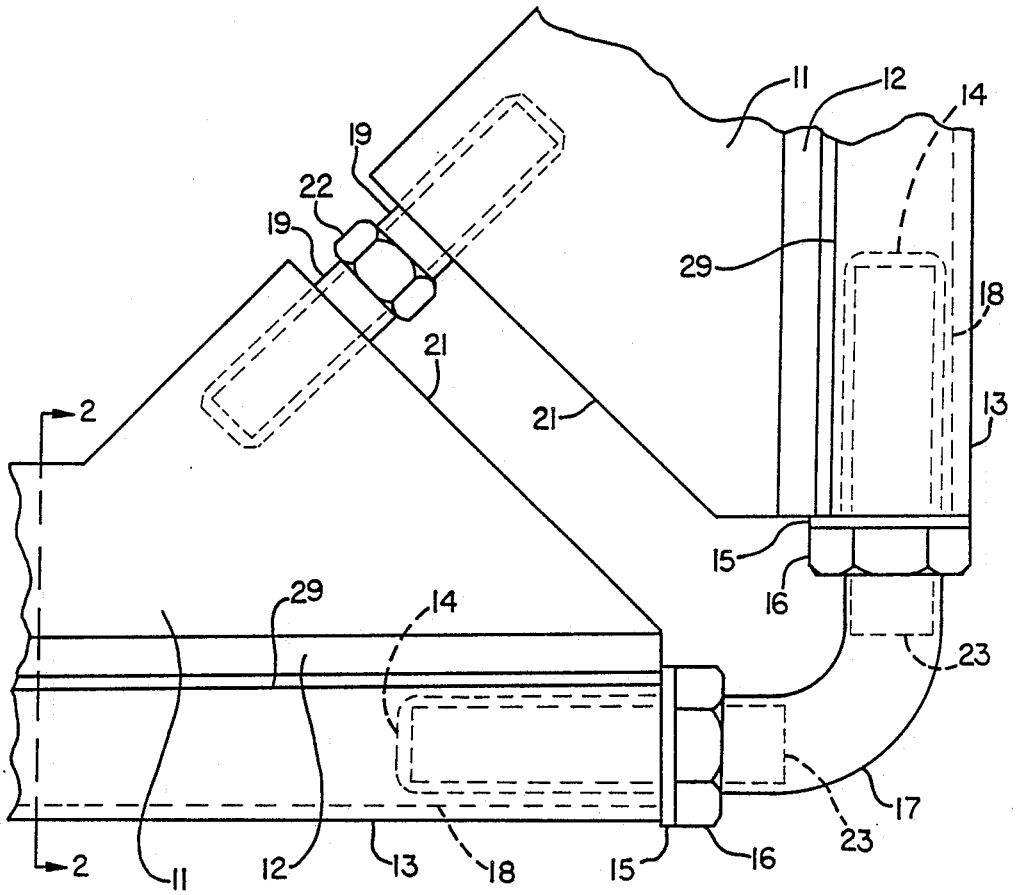
FIG. 1 is a fragmentary plan view of one corner of square manhole cover support having a four-segment body that is adjustable as to periphery.
Figure 2:
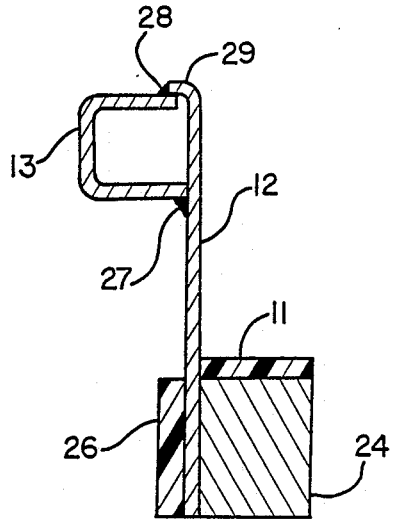
FIG. 2 is a vertical cross section taken through Section 2-2 of FIG. 1.

Reference is made to FIGS. 1 and 2. FIG. 1 shows one corner of the four like corners of a square, four-segmented manhole cover support that is adjustable as to periphery of its base portion at the corners. FIG. 2 shows the vertical cross section of one segment.

Like parts of a segment are given the same numbers for simplicity. It should be understood that in the complete cover support of this type there would be four sets of like-numbered main elements that constitute the metal body and of the polymeric coatings thereon. These would be the base, the coated seat, the lateral cover keeper, the wale, and the channel portions, the turnbuckles of the base portion, the bridging pieces and nuts for the ends of the wale portion, and the frictional retention component, even though only one or two of such elements might be shown in FIGS. 1 and 2.

Sheet steel keeper portion 12 (13 Gauge, 0.09375 inch thick) is welded to solid cast ductile iron (grade 45-12 or 536) base portion 24. The bottom of keeper portion 12 forms the outside of the base part of each segment and is coated with about an ⅛ inch thick, adherent, heat-cured coating of a vinyl plastisol as frictional retention component 26.

Turning of the turnbuckle wrench grip 22 causes oppositely-threaded bolt ends 19 to widen or narrow the gap between oblique faces 21 of the base 24. When the opposing ends of wale portion 18 are not constrained, there is a concomitant change in the gap between such wale ends. Seat 11 for the cover is a coating of heat-cured plastisol like the retention component 26. Seat 11 is for sealing and helping to soundproof the cover that will rest thereon. Otherwise the cover can find its seat right on the top of the iron base 24.

The top of keeper portion 12 is a slight outward flange 29. A sheet steel channel portion (also 13-gauge mild steel) is welded to the keeper by welds 27 and 28 to form hollow wale portion 13. Wale portion 13 is coextensive with the top of the keeper 12. The channel portion ends act as receivers for bridging piece 17, which has a round, heavy cross section.

Bridging the channel ends with a 90° bend is threaded bridging piece 17. When not constrained, it slides into the open ends of wale portion 13. The threading is represented on the straight terminal shafts of piece 17 between the limits marked as 23 and 14. Nuts 16 are tightenable against washers 15 on the threads of piece 17 for bracing the ends of wale 13 together (after the base 24 has been expanded tightly against the constraint of the collar of an existing manhole cover frame, not shown, and clamped down thereunder by clamps, not shown, during installation of the support in the frame).

In this manner the top elements of the new support, namely the wale portion 13 and the upper part of keeper portion 12, are maintained in a mutually-strengthening relationship for resisting rigors of service better than if the bridging pieces were loose in their receivers or simply pressing against one of them.

The gaps at the corners of the cover support can be plugged with preformed, deformable, preferably somewhat elastomeric sealing plugs or with deposits of a water-impervious, somewhat elastomeric, polymer-containing sealant such as a foam dispensed as a fluid and self-setting (firming into a tough solid) in place. Thus, with the cured plastisol frictional retention component around the outside of the base portion, the full seat portion coated likewise, and the joints all plugged, the cover support is capable of being practically proof against infiltration of surface drainage provided that the manhole cover is imperforate.

Figure 3:
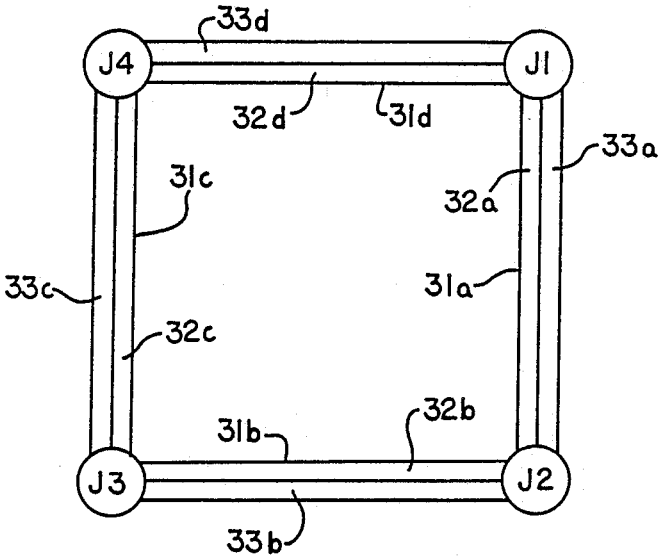
FIG. 3 is a schematic plan of a square cover support with four corners, each like that of FIG. 1.

The schematic plan view of the metal cover support of FIG. 3 indicates four segments connected at the corners by joints J1, J2, J3 and J4. Each joint can be like that depicted in FIG. 1. The wale portion is indicated as 33 *a, b, c* and *d*, the seat portion as 32*a, b, c* and *d*, the base portion as 31*a, b, c* and *d*. Alternatively, the four pieces of the base portion 31 could be bolted together fixedly as in FIG. 8 while the wale portion 33 is interbraced as in FIG. 1.

Figure 4:
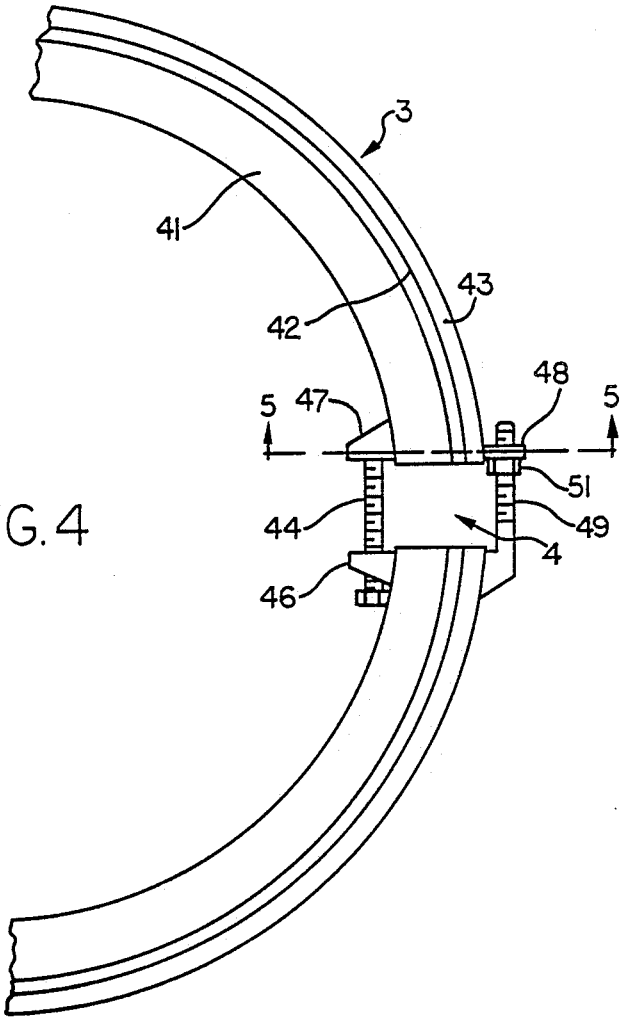
FIG. 4 is a fragmentary plan view of a split ring type cover support embodying the instant improvement.
Figure 5:
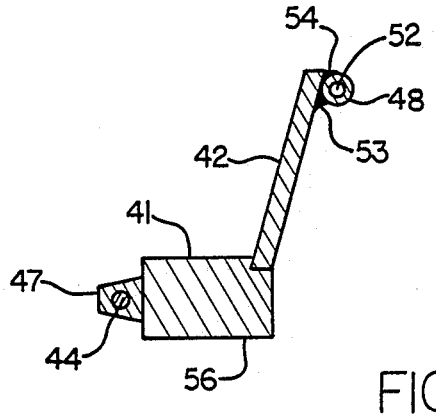
FIG. 5 is a vertical cross section taken through Section 5-5 of FIG. 4.

Referring to FIGS. 4 and 5, arrow 3 refers generally to a split ring cover support. It has a cast ductile iron base portion 56 with cover seat portion 41. The keeper portion 42 is welded to base portion 56 and rises from seat portion 41. Threaded bolt 44 is screwed through a threaded hole in post 46 and against reaction post 47 for spreading (gradually springing open) the gap indicated generally by arrow 4, between the base portion ends and the keeper portion ends. Welded to near the top of the keeper portion end below the gap is the fixed end of threaded bridging piece 49, a heavy steel bolt. The piece 49 passes through hole 52 in ring 48. Nut 51 is tightenable against the ring to brace the ends of the top of keeper portion 42.

Figure 6:
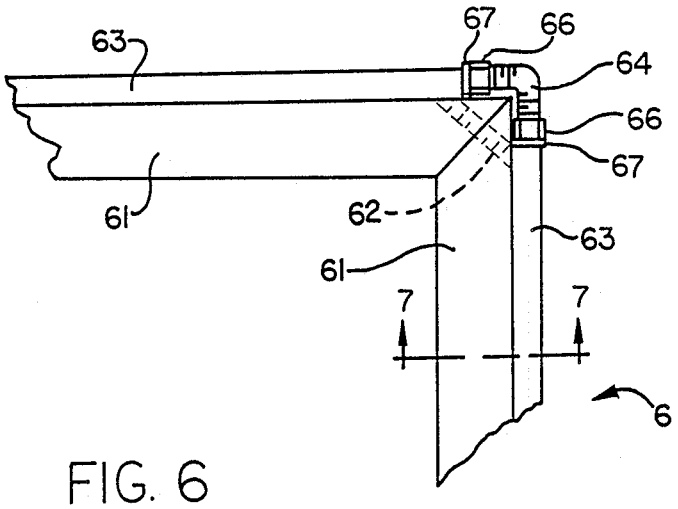
FIG. 6 is a fragmentary plan view of a corner of a rectangular manhole cover support seen from the bottom up, the base of this support being fixed as to periphery.
Figure 7:
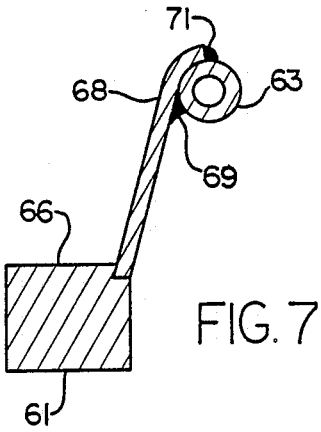
FIG. 7 is a vertical cross section taken through section 7-7 of FIG. 6.

In FIG. 6 the mitered corners of solid cast iron base portion segments 61 are joined fixedly by the screw 62 that crosses the joint. These base segments also could be hollow sheet steel members with iron or steel end plugs for making a like screwed connection. The ends of solid, round wale portions 63 are bored several inches deep to admit threaded heavy bridging piece 64 slidably therein. Nuts 66 on the straight end shafts of the bridging piece force washers 67 against the pairs of adjacent wale portion ends to achieve the interbracing. The cross section view of FIG. 7 shows the sheet steel keeper portion 68 welded to base portion 61 and rising from seat portion 66. Wale portion 66 is welded to the keeper portion 68 by welds 69 and 71. The end of the bore hole 65 in wale portion 63 also is evident.

Figure 8:
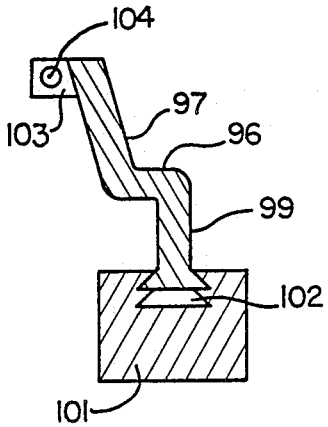
FIG. 8 is the vertical cross section of a segment of a rectangular cover support that has its seat portion detachable from its base portion and is adjustable as to height.

Referring to FIG. 8, the cross section shown is taken very near a joint to show the projecting receiver lug 103 with hole 104 in it for fitting an appropriate bridging piece. The parts shown all are of cast ductile iron. The foot portion 99 (below seat portion 96 and riser portion 98 of a straight segment of this rectanglar manhole cover support) is trapezoidal in cross section. The foot portion 99 fits slidably lengthwise into either one of the trapezoidal slot portions below in base portion 101; there can be more than two such slot portions, one above the other; the bottom slot portion here is labelled 102. Keeper portion 97 rises from seat portion 96. Lug 103 projects from the side of keeper portion 97 at its top; the lug has a hole through which to pass slidably a threaded bolt (not shown) like the bolt 49 of FIG. 4, and to react against a nut, also not shown, that runs on such bolt for effecting bracing between the ends of the keeper portion tops.

While the cover support embodiments depicted are for circular and square holes, it is contemplated that other polygons, e.g. triangles and octagons, as well as ovals, etc. also are possible shapes for cover supports in accordance with invention principles. If the bases of the supports are to be rendered adjustable as to their perimeter, usually turnbuckle means are used at the joints. Fixed joining of distinct steel pieces to iron or steel here preferably is done by welding the parts together where feasible. However, other attaching methods can be used, eg. brazing, soldering, riveting and/or bolting.

The cover support can be made in segments for attaching together without being made adjustable in periphery. Thus, several straight and/or curved pieces can be joined, e.g. bolted together, to form a support of fixed base periphery.

It is possible to use conventional elevating means to adjust the level of the cover support. Thus, lifting screws can be fitted into the base portion, and shims or gaskets can be placed under it. Hold-down means for the new cover support, such as screw-operated or turnbuckle-operated clamps running from the base portion downwardly to clamp tightly under the sill of the existing frame or other structure below the new cover support installation, normally are used.

Suitable translatable checking followers on bridging pieces for exerting pressure against the receiver that retain them usually are of a nut or washer type; some are referred to as being self-locking into place. The preferred type for adjustment is a nut running on a threaded straight shaft of the bridging piece, the nut being tightenable against the end of a receiver or the face of an interposed washer, e.g. one that is flat or locking.

Another such checking follower works on a straight, slab-sided bridging piece shaft having serrations or threads only above and below the slab sides or at squared corners, like some doorknob shafts. The follower is an annular nut-like follower, slidable over such shaft when oriented one way with respect to the shaft and having matching serrations or threads only on each side of its interior for engaging the complementary threads or serrations along the shaft when the follower is rotated, e.g. 90°. This sort is of the interrupted thread or serration type.

A variation on a threaded or otherwise serrated shaft follower for this purpose is a washer that is slidable over the shaft, the washer having a detent pivotally mounted on the back of it to engage behind it the threads or serrations on the shaft as the washer is pressed against the receiver. A further variation of such follower is a "Speed Nut" (the trademark for a plate having a screw hole and at least one springy thread-engaging tooth end forming part of the screw hole perimeter) on a shaft threaded for such device.

Still another such follower is a washer-like piece that is slidable on the bridging piece shaft; it is cocked to lock thereon when pressed against the receiver. Usually such washer-like piece is flat and comparatively thin, e.g. ⅛ inch or less, and it has a center hole whose central axis is at a slight angle away from normal to the flat face.

Yet another such follower is simply a washer slidable over a bridging piece shaft that has a series of holes along its length to receive pins or wedges that can be driven behind the washer when it is thrust against an end of the receiver.

Another such follower comprises a substantially annular sleeve slotted longitudinally to slide past a lug projecting from the shaft of a round bridging piece. The slot has indentations substantially transverse to its length for accepting the lug at various points when the sleeve is pressed against the end of a receiver or an interposed washer, then rotated. Alternatively, the washer or a like ring can be unitary and concentric with such sleeve.

In a variation of such sleeve device, a sleeve of springy material, e.g. a metal, can be slotted with a longitudinal slot having undulating edges that abut at rest to form a line of clasping holes for the lug on the bridging piece. The sides of the slot are sprung apart and the sleeve slid towards or away from the receiver end, then allowed to re-close around the lug at a chosen fixed interval.

Suitable polymers that can be formulated for use in the compressible retention component and for water seals herein include natural and synthetic rubbers, cork compounds, water resistant ionomers, various vinyl polymers and copolymers such as polyvinyl acetatepolyethylene-acrylate copolymers and polyvinyl chloride homopolymers, polyurethanes, polyesters resins, epoxy resins, styrene-containing copolymers such as ABS and butadiene-styrene or isoprene-styrene copolymers, polyolefins and copolymers containing olefin units, and aminoplasts. Plasticizers, pigmentation, stains and/or mineral fillers such as talc, carbon black, etc. commonly are employed in their recipes, but unpigmented and unfilled recipes are preferred for their efficiency. The best retention components appear to be elastomeric. Many of them can be foamed and preferably are foamed only very slightly; this can soften them a bit, and it makes them slightly less dense than without the foaming. Latent foaming agents reactive upon warming and/or catalyzing a film of an uncured polymer-providing material coated on a cover support are preferred. Curing the polymer-containing with heat, ultraviolet or electron beam radiation and/or catalysis can be practiced.

Customarily, it is of advantage to prime the metal with a bonding agent or use a bonding treatment to secure the best bond of the retention component or a water sealing element to metal. Some polymers can bond well without this, e.g., epoxy resins. However, the bonds of most are improved by such priming and/or treating.

A preferred foamed plastisol formulation for the retention component is of Shore A Durometer hardness about 20–70, and preferably about 50–65, as are the water seals. The plastisol is compounded principally from low molecular weight polyvinyl chloride resin plasticized heavily with a conventional phthalate ester plasticizer. It contains minute percentages of stabilizer, red colorant and ozodicarbonamide blowing agent. Another preferred formulation of about the same Shore A Durometer hardness is a flexible polyolpolyurethane foam, slightly elastomeric and rubbery. Some polymer recipes need heat to cure and foam, even with catalysis, and others cure and even foam at about room temperature (78° F.). The degree of foaming in both these plastisol and urethane formulations is very small, and it could be called almost microscopic and slight—the bubbles are closed-cell and tiny. In some cases, especially where sealing is to be maximized and strength considerations are secondary, a fair amount of foaming and a resulting softened and less dense foamy structure can be tolerated, e.g., Shore A Durometer hardness of 20–55.

The preferred foamed plastisol usually is sprayed on the area to be coated. It is advantageous to spray it onto the hot metal cover support body (370°–380° F.) and let it cure (harden and toughen) and foam a bit. If extra foaming and/or curing is desired, the coated part can be further warmed at 380°–400° F. for up to a few minutes. The thickness of the retention component desirably is between about 40 and 400 mils to take care of, on the thinner side, minor surface irregularities and markedly increase the frictional grip between cover support and existing frame (or other original cover-seating receptacle) while, on the thicker side, neither rendering the seat of the cover support too constricted to accept the same cover that was used for the existing cast iron frame (or other original cover-seating receptacle) nor lacking in metal-to-metal bearing surface between its base and the seat of that existing frame.

Metal surfaces should be cleaned to accept the polymeric material if it is to be bonded to the metal. Then a customary bonding agent such as Chemlok #218 (Manufactured by Lord Corporation, Erie, Pa.) is applied, dried and warmed. Various other useful bonding agents are available such as a Pliobond type (made by the Goodyear Tire and Rubber Company).

As shown above, the preferred materials of construction for most of the cover support, i.e., the body and various elements of the body, are of a ferrous metal, e.g., steel and/or cast iron, particularly cast ductile iron. Other metals can be used where their special properties are desirable and their cost can be tolerated), e.g., stainless steel, high tensile strength steel, wrought iron, bronze, brass, etc. Desirably screw threads will have nylon locking patches, these usually being sprayed on.

Many modifications and variations of the invention will be apparent to those skilled in the art in the light of the foregoing detailed disclosure. Therefore, it is to be understood that, within the scope of the appended claims, the invention can be practiced otherwise than as shown and described.

I claim:

1. A manhole cover support for raising the effective grade of an existing manhole cover receiving structure, the support having a metal body comprising a base portion, a seat portion thereabove for seating the manhole cover, the seat portion directed inwardly, a cover keeper portion that rises from the outer periphery of the seat portion and has at least a pair of opposing ends that define a gap between them, a bridging piece for spanning each said gap, the bridging piece having at least one free end, a receiver for slidably retaining each free end of each bridging piece, the receiver being attached to and protruding outwardly from the keeper portion near the top thereof, the bridging piece including means for exerting pressure against the receivers that retain it.

2. The manhole cover support of claim 1 wherein the body is in the form of a split ring of ferrous metal.

3. The manhole cover support of claim 1 wherein the body is in segments and is of ferrous metal.

4. The manhole cover support of claim 1 wherein the receiver is a wale portion substantially coextensive with the top of the keeper portion.

5. The manhole cover support of claim 1 wherein each of the free ends of the bridging pieces are fitted with a translatable checking follower for exerting pressure against a receiver.

6. The manhole cover support of claim 5 wherein the bridging piece has two free ends, and each free end has a receiver therefor.

7. The manhole cover support of claim 1 which is generally polygonal in plan and has joints at the corners.

8. The manhole cover support of claim 1 wherein there is a frictional retention component around the outer wall of the base portion.

9. The manhole cover support of claim 8 wherein there is a water seal comprising polymer on the seat portion, and a water-sealing plug comprising polymer at each joint.

10. The manhole cover support of claim 9 wherein the water seal is bonded to the seat portion, and the frictional retention component is bonded to the base portion.

11. In a manhole cover support for raising the effective grade of an existing manhole cover receiving structure, the support having a ferrous metal body comprising a base portion, a seat portion thereabove for the manhole cover, the seat portion directed inwardly, a cover keeper portion that rises from the outer periphery of the seat portion and has at least a pair of opposing ends that define a gap between them, at least one joint with spreader means for adjusting the body in peripheral dimension and, concomitantly, the width of the gaps between opposing ends of the keeper portion, a bridging piece spanning each said gap, said bridging piece having at least one free end, a receiver for the free ends of each bridging piece, the receiver being attached to and protruding outwardly from the keeper portion near the top thereof and slidably retaining a free end, the improvement which comprises: each free end of a bridging piece is threaded and equipped with a nut mountable thereon, the nut being tightenable for exerting parting pressure against the receiver.

12. The manhole cover support of claim 11 wherein the body is a split ring with an adjustable joint at the split.

13. The manhole cover support of claim 11 wherein the body comprises a plurality of segments, and each segment has a joint equipped with spreader means for adjusting the body in peripheral dimension.

14. The manhole cover support of claim 11 wherein, the receiver is a hollow wale portion that is substantially coextensive with the top of the keeper portion and protrudes outwardly from the keeper portion, and the wale portion comprises at least one piece of attached metal that is distinguishable from the rest of the wale.

15. The manhole cover support of claim 11 which is segmented and has a joint at each corner.

16. The manhole cover support of claim 15 which is generally rectangular in plan and has pairs of base portion ends that face each other, are oblique to the longitudinal axes of their respective segments, and are connected by a turnbuckle bolt.

17. The manhole cover support of claim 11 wherein the seat portion is the top of the base portion.

18. The manhole cover support of claim 11 wherein the seat portion is detachable from the base portion.

19. The manhole cover support of claim 11 wherein there is a frictional retention component comprising polymer around the outer part of the base.

20. The manhole cover support of claim 19 wherein there is a water seal comprising a polymer on the seat, and a deformable water sealing plug comprising polymer at each joint.

21. The manhole cover support of claim 20 wherein the frictional retention component is bonded to the base portion, and the, water seal is bonded to the seat.

22. A manhole cover support for raising the effective grade of an existing manhole cover receiving structure, the support having a ferrous metal body comprising a base portion having a seat portion for a manhole cover as its top, the seat portion directed inwardly, a cover keeper portion that rises from the outer periphery of the seat portion and has at least a pair of opposing ends that define a gap between them, a hollow wale portion that is substantially coexistensive with the top of the keeper portion and protrudes outwardly from the keeper portion, the wale portion having open termini and comprising at least one piece of metal that is fastened to and distinguishable from the rest of the wale, at least one joint with spreader screw means for adjusting the body in peripheral dimension and, concomitantly, the width of the gaps between the opposing ends of the keeper portion, a bridging piece spanning each said gap, said bridging piece having two free ends, the hollow wale portion slidably receiving through its open termini the free ends of each bridging piece, each end of a bringing piece being threaded and equipped with a nut, the nut being tightenable to exert pressure against an open end of a wale portion terminus.

23. The manhole cover of claim 22 that is generally polygonal in plan, has base and seat portions of cast ductile iron, keeper and wale portions of steel sheet, and a joint at each corner.

24. The manhole cover support of claim 23 that is generally rectangular in plan and has pairs of base portion ends that face each other, are oblique to the longitudinal axes of their respective segments, and are connected by a turnbuckle bolt.

25. The manhole cover support of claim 22 wherein there is a frictional retention component comprising polymer around the outer wall of the base portion.

26. The manhole cover support of claim 22 wherein there is a water seal comprising polymer around the outer wall of the base portion and a water-sealing plug comprising polymer at each joint.

27. The manhole cover support of claim 26 wherein the water seal is bonded to the seat portion, and the frictional retention component is bonded to the base portion.

* * * * *